US011015319B2

(12) United States Patent
Izumikawa

(10) Patent No.: US 11,015,319 B2
(45) Date of Patent: May 25, 2021

(54) VEHICLE SHOVEL

(71) Applicant: SUMITOMO(S.H.I.) CONSTRUCTION MACHINERY CO., LTD., Tokyo (JP)

(72) Inventor: Takeya Izumikawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/715,609

(22) Filed: Sep. 26, 2017

(65) Prior Publication Data

US 2018/0016768 A1 Jan. 18, 2018

Related U.S. Application Data

(63) Continuation of application No. PCT/JP2016/059684, filed on Mar. 25, 2016.

(30) Foreign Application Priority Data

Mar. 27, 2015 (JP) ..... JP2015-067684

(51) Int. Cl.
*E02F 3/43* (2006.01)
*E02F 3/32* (2006.01)
(Continued)

(52) U.S. Cl.
CPC ..... *E02F 3/439* (2013.01); *E02F 3/32* (2013.01); *E02F 3/3677* (2013.01); *E02F 3/435* (2013.01);
(Continued)

(58) Field of Classification Search
CPC ... E02F 3/32; E02F 3/439; E02F 3/435; E02F 9/262; E02F 9/265; E02F 3/3677; E02F 9/2041; E02F 9/264; E02F 9/2045
(Continued)

(56) References Cited

U.S. PATENT DOCUMENTS 4,332,517 A * 6/1982 Igarashi ..... E02F 3/437 172/4.5
6,076,029 A * 6/2000 Watanabe ..... E02F 3/437 701/50
(Continued)

FOREIGN PATENT DOCUMENTS

DE 112013000124 12/2014
GB 2149751 6/1985
(Continued)

OTHER PUBLICATIONS

Control of virtual excavating system base on real-time simulation; Quang Hoan Le;Young-man Jeong;Chi Thanh Nguyen; Soon-Yong Yang; 2012 12th International Conference on Control, Automation and Systems; IEEE Conference Paper. (Year: 2012).*
(Continued)

*Primary Examiner* — Cuong H Nguyen
(74) *Attorney, Agent, or Firm* — IPUSA, PLLC

(57) ABSTRACT

A shovel includes an arm rotatably attached to a boom rotatably attached to a revolving body; a bucket rotatably attached to the arm; a tilt mechanism configured to support the bucket that can be tilted to the arm; a bucket tilt angle sensor configured to detect a tilt angle of the bucket; and a tilt angle controller configured to control adjusting the tilt angle, wherein the tilt angle controller adjusts the tilt angle by automatic control so that a bucket line of the bucket becomes parallel to a target excavation surface.

12 Claims, 6 Drawing Sheets

(51) Int. Cl.
*E02F 3/36* (2006.01)
*E02F 9/22* (2006.01)
*E02F 9/20* (2006.01)
*E02F 9/26* (2006.01)

(52) U.S. Cl.
CPC ..... *E02F 9/2041* (2013.01); *E02F 9/22* (2013.01); *E02F 9/262* (2013.01); *E02F 9/265* (2013.01)

(58) Field of Classification Search
USPC ..... 701/50, 408; 414/701; 37/341, 348, 37/413–414; 340/689
See application file for complete search history.

(56) References Cited

U.S. PATENT DOCUMENTS 6,532,409 B1 * 3/2003 Fujishima ..... E02F 9/2045 701/50
7,967,547 B2 * 6/2011 Osanai ..... E02F 3/432 414/697
7,993,091 B2 * 8/2011 Osanai ..... B66F 9/065 414/697
8,914,199 B2 * 12/2014 Nomura ..... E02F 3/32 340/995.27
9,020,709 B2 * 4/2015 Matsuyama ..... E02F 9/262 701/51
9,080,317 B2 * 7/2015 Matsuyama ..... E02F 9/2203
9,938,694 B2 * 4/2018 Matsuyama ..... E02F 9/20
10,138,618 B2 * 11/2018 Davis ..... E02F 9/2041
10,704,228 B2 * 7/2020 Tsuji ..... E02F 9/26
2003/0001751 A1 * 1/2003 Ogura ..... E02F 9/2296 340/691.6
2005/0027420 A1 * 2/2005 Fujishima ..... E02F 9/2045 701/50
2006/0291987 A1 * 12/2006 Osanai ..... B66F 9/065 414/685
2009/0159302 A1 * 6/2009 Koch ..... E02F 3/437 172/2
2010/0254793 A1 * 10/2010 Trifunovic ..... E02F 3/432 414/700
2012/0283920 A1 * 11/2012 Kim ..... B62D 55/116 701/50
2014/0095036 A1 * 4/2014 Hoff ..... B60W 10/11 701/65
2014/0129093 A1 * 5/2014 Shirao ..... E02F 3/432 701/50
2014/0142817 A1 5/2014 Matsuyama
2014/0330490 A1 * 11/2014 Aoki ..... E02F 9/2079 701/50
2015/0275471 A1 * 10/2015 Matsumoto ..... E02F 3/3417 701/50
2015/0308082 A1 10/2015 Takaura et al.
2015/0345114 A1 12/2015 Nomura et al.
2016/0040391 A1 * 2/2016 Imaizumi ..... E02F 9/2203 701/50
2016/0040398 A1 * 2/2016 Kitajima ..... E02F 3/435 701/50
2016/0138240 A1 * 5/2016 Ikegami ..... E02F 9/2285 701/50
2016/0251835 A1 * 9/2016 Kitajima ..... E02F 3/3663 701/50
2016/0312434 A1 * 10/2016 Shintani ..... E02F 9/262
2018/0016768 A1 1/2018 Izumikawa

FOREIGN PATENT DOCUMENTS

JP S54-004402 1/1979
JP 63236827 A * 10/1988 ..... E02F 3/437
JP 2002-030690 1/2002
JP 2013-217137 10/2013
JP 2014-074319 4/2014
WO 2012/127912 9/2012
WO 2014/051170 4/2014
WO WO-2014093625 A1 * 6/2014 ..... E02F 3/20
WO 2014/192475 12/2014
WO 2016/158779 10/2016

OTHER PUBLICATIONS

Path tracking for a hydraulic excavator utilizing proportional-derivative and linear quadratic control; Seonhyeok Kang;Jaemann Park;Seunghyun Kim;Bongju Lee;Youngbum Kim;Panyoung Kim;H. Jin Kim; 2014 IEEE Conference on Control Applications (CCA); IEEE Conference Paper. (Year: 2014).*
Predicting Parameters by Neural Network Learning and Nonlinear Controls of the Hydraulic Crawler Excavator Using Them Jong-Gyu Park;Quoc-Dong Hoang;Soon-Geul Lee; 2020 20th International Conference on Control, Automation and Systems (ICCAS); IEEE Conference Paper. (Year: 2020).*
Research on laser beam riding guided excavator; Jiang Haiyong;Qi Xiaona;Liu Jiangtao;Li xin; 2010 2nd International Asia Conference on Informatics in Control, Automation and Robotics (CAR 2010); IEEE Conference Paper vol. 1. (Year: 2010).*
International Search Report for PCT/JP2016/059684 dated Jun. 14, 2016.

* cited by examiner

VEHICLE SHOVEL

CROSS-REFERENCE TO RELATED APPLICATIONS

This application is a continuation application of International Application PCT/JP2016/059684 filed on Mar. 25, 2016, and designated the U.S., which claims priority based on Japanese Patent Application No. 2015-067684 filed on Mar. 27, 2015. The entire contents of each of the foregoing applications are incorporated herein by reference.

BACKGROUND

Technical Field

The present disclosure relates to a shovel having a bucket tilt mechanism.

Description of Related Art

Excavation control systems have been proposed that automatically adjust the cutting-edge position of a bucket of a shovel, and execute excavation restriction control so as to move the cutting edge of the bucket along a designed surface. Such a shovel has, as a bucket rotational axis, a single rotational axis that is parallel to a road surface or the like on which the shovel is installed. Therefore, the cutting edge of the bucket is always maintained parallel to the road surface.

When excavating a slope surface (a slope) with a bucket, it is preferable to move the bucket diagonally upward or diagonally downward along the slope surface, while maintaining the teeth end of the bucket parallel to the slope surface. In the above excavation control system, when the longitudinal direction of the boom and the arm coincides with the vertical direction of the slope surface, the teeth end of the bucket is parallel to the slope surface. However, if the bucket is moved along the slope surface while revolving the revolving upper body to which the boom is attached, the longitudinal direction of the boom and the arm inclines to the vertical direction of the slope surface, and consequently, a bucket line formed by working parts of the bucket (including, for example, a teeth end line connecting both ends of the cutting edge (an example of a working part), and a back surface line along the edge of the back surface of the bucket (an example of a working part)) inclines to the slope surface. In this case, the surface excavated by the bucket inclines to the slope surface, and hence, it is not possible to make the excavated surface precisely fit the target surface.

SUMMARY

According to an embodiment in the present disclosure, a shovel includes an arm rotatably attached to a boom rotatably attached to a revolving body; a bucket rotatably attached to the arm; a tilt mechanism configured to support the bucket that can be tilted to the arm; a bucket tilt angle sensor configured to detect a tilt angle of the bucket; and a tilt angle controller configured to control adjusting the tilt angle, wherein the tilt angle controller adjusts the tilt angle by automatic control so that a bucket line of the bucket becomes parallel to a target excavation surface.

DETAILED DESCRIPTION

In the following, embodiments will be described with reference to the drawings.

According to a disclosed embodiment, the tilt angle of the bucket is automatically corrected while operating the shovel so that the bucket line is always parallel to the inclined target surface. This makes it possible, for example, if excavation work on a slope surface is performed while revolving the revolving upper body, to raise precision of the excavation surface because the bucket line is always maintained parallel to the slope surface automatically.

Figure 1:
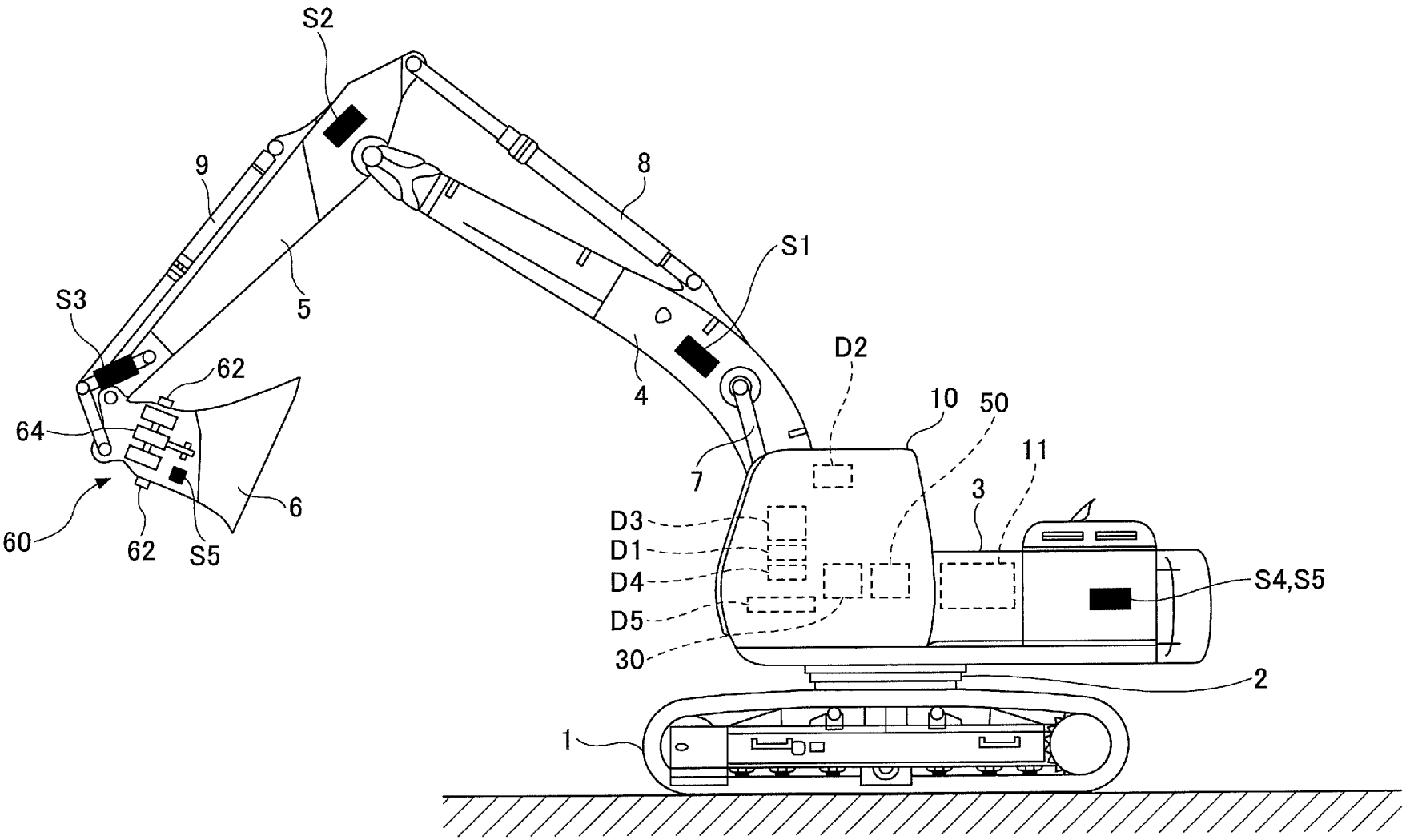
FIG. 1 is a side view of a shovel according to an embodiment.

FIG. 1 is a side view of a shovel according to an embodiment. A revolving upper body 3 is mounted on a traveling lower body 1 of the shovel via a revolution mechanism 2. A boom 4 is attached to the revolving upper body 3. An arm 5 is attached at the tip of the boom 4, and a bucket 6 as an end attachment is attached at the tip of the arm 5. As the end attachment, a bucket for slope surface, a bucket for dredging, or the like may be used.

As an example of an attachment, the boom 4, the arm 5, and the bucket 6 constitute an excavation attachment, which are oil-pressure driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The boom angle sensor S1, the arm angle sensor S2, and the bucket angle sensor S3 may be referred to as "orientation sensors".

The bucket 6 is what-is-called a tilt bucket; the bucket 6 is rotatable in a direction perpendicular to the page surface with respect to the arm 5. Specifically, a tilt mechanism 60 is provided at a portion at which the bucket 6 is attached to the arm 5. The tilt mechanism 60 has a pin 62 (tilt axis) that rotatably supports the bucket 6, and a tilt bucket cylinder 64 for rotating the bucket 6. By driving the tilt bucket cylinder 64, it is possible to rotate the bucket 6 around the pin 62. Note that a bucket tilt angle sensor S5 is attached to the bucket 6. The bucket tilt angle sensor S5 is a sensor that detects an angle of rotation of the bucket 6 around the tilt axis, and outputs the detected value.

The boom angle sensor S1 detects a rotation angle of the boom 4. In the embodiment, the boom angle sensor S1 is an acceleration sensor that detects inclination to the level surface, and detects a rotation angle of the boom 4 with respect to the revolving upper body 3. The arm angle sensor S2 detects a rotation angle of the arm 5. In the embodiment, the arm angle sensor S2 is an acceleration sensor that detects inclination to the level surface, and detects a rotation angle of the arm 5 with respect to the boom 4. The bucket angle sensor S3 detects a rotation angle of the bucket 6. In the embodiment, the bucket angle sensor S3 is an acceleration sensor that detects inclination to the level surface, and detects a rotation angle of the bucket 6 with respect to the arm 5. The boom angle sensor S1, the arm angle sensor S2, and the bucket angle sensor S3 may be a potentiometer using a variable resistor, a stroke sensor that detects the amount of strokes of the corresponding oil pressure cylinder, a rotary encoder that detects the rotation angle around a linking pin, or the like.

The revolving upper body 3 has a cabin 10, and has a power source such as an engine 11 installed. Also, a body inclination sensor S4 is attached to the revolving upper body 3. The body inclination sensor S4 is a sensor that detects inclination of the revolving upper body 3 to the level surface. In the embodiment, the body inclination sensor S4 is a biaxial acceleration sensor that detects inclination angles in a back-and-forth direction and a right-and-left direction of the revolving upper body 3. The body inclination sensor S4 may be referred to as an "orientation sensor".

In the cabin 10, an input unit D1, a sound output unit D2, a display unit D3, a memory unit D4, a gate lock lever D5, a controller 30, and a machine guidance device 50 are installed.

The controller 30 functions as a main controller that executes drive control of the shovel. In the embodiment, the controller 30 is constituted with an arithmetic processing unit including a CPU and an internal memory. Various functions of the controller 30 are implemented by the CPU that runs a program stored in the internal memory.

The machine guidance device 50 guides operations of the shovel. In the embodiment, the machine guidance device 50 visually and auditorily informs the operator, for example, about a distance in the perpendicular direction between the surface of a target geographical feature set by the operator and the tip (teeth end) position of the bucket. As such, the machine guidance device 50 guides operations of the shovel performed by the operator. Note that the machine guidance device 50 may only visually inform the operator, or may only auditorily inform the operator, about the distance. Specifically, similar to the controller 30, the machine guidance device 50 is constituted with an arithmetic processing unit including a CPU and an internal memory. Various functions of the machine guidance device 50 are implemented by the CPU that runs a program stored in the internal memory. The machine guidance device 50 may be provided as a device separate from the controller 30, or may be built in the controller 30.

The input unit D1 is a device for an operator of the shovel to input various information items into the machine guidance device 50. In the embodiment, the input unit D1 is a membrane switch attached to the surface of the display unit D3. A touch panel or the like may be used as the input unit D1. The operator can input a target excavation surface by using the input unit D1. Also, the operator may input the height from the target excavation surface so as to set a tilt control start surface used as a reference to start automatic bucket tilt control, which will be described later. Accordingly, the target excavation surface and the tilt control start surface are stored in the memory unit D4 of the machine guidance device 50. Also, at least one of the target excavation surface and the tilt control start surface may be stored in the memory unit D4 via communication.

The sound output unit D2 outputs various audio information items in response to a sound output command from the machine guidance device 50. In the embodiment, an in-vehicle speaker directly connected to the machine guidance device 50 is used as the sound output unit D2. Note that an alarm such as a buzzer may be used as the sound output unit D2.

The display D3 displays various image information items in response to a command from the machine guidance device 50. In the embodiment, an in-vehicle liquid crystal display directly connected to the machine guidance device 50 is used as the display unit D3.

The memory unit D4 is a device for storing various information items. In the embodiment, a non-volatile storage medium, such as a semiconductor memory, is used as the memory unit D4. The memory unit D4 stores various information items output by the machine guidance device 50 and the like.

The gate lock lever D5 is a mechanism to prevent the shovel from being operated erroneously. In the embodiment, the gate lock lever D5 is placed between the door of the cabin 10 and the driver's seat. If the gate lock lever D5 is pulled up so that the operator cannot leave the cabin 10, various operation units become operational. On the other hand, if the gate lock lever D5 is pressed down so that the operator can leave the cabin 10, various operation units become not operational.

Figure 2:
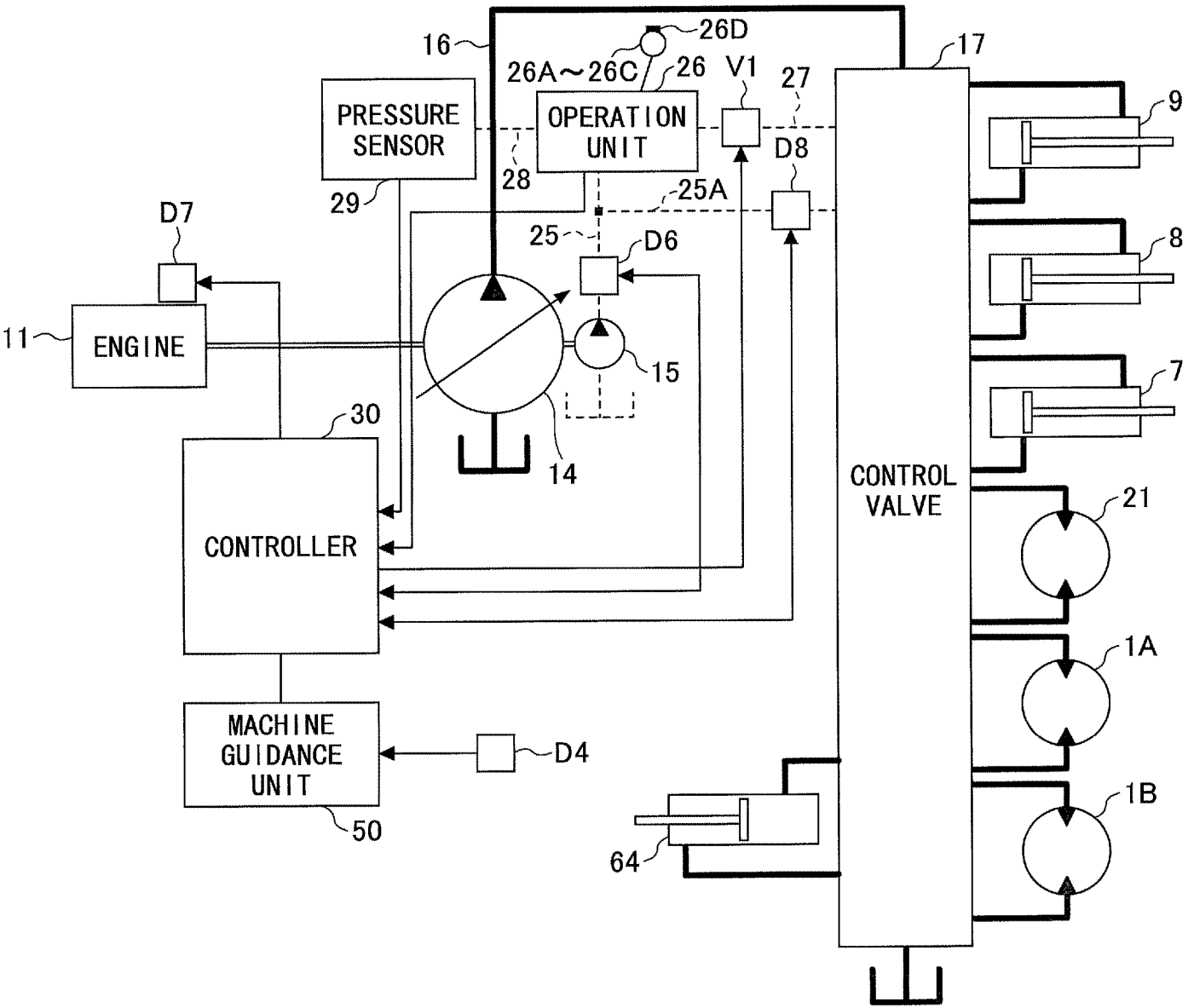
FIG. 2 is a block diagram illustrating a configuration of a drive system of the shovel illustrated in FIG. 1.

FIG. 2 is a block diagram illustrating a configuration of a drive system of the shovel in FIG. 1. In FIG. 2, a mechanical drive system is represented by double lines, high-pressure oil pressure lines are represented by bold solid lines, pilot lines are represented by dashed lines, and an electrical drive-and-control system is represented by thin solid lines, respectively.

The engine 11 is the power source of the shovel. In the embodiment, the engine 11 is a diesel engine that adopts isochronous control to maintain a constant number of revolutions of the engine irrespective of increase or decrease of the engine load. The amount of fuel injection, fuel injection timing, boost pressure, and the like in the engine 11 are controlled by the engine controller D7.

The engine controller D7 is a device that controls the engine 11. In the embodiment, the engine controller D7 executes various functions including an automatic idling function and an automatic idling stop function.

The automatic idling function is a function to reduce the number of revolutions of the engine from a normal number of revolutions (for example, 2,000 rpm) to a number of revolutions for idling (for example, 800 rpm) if a predetermined condition is satisfied. In the embodiment, the engine controller D7 activates the automatic idling function in response to an automatic idling command from the controller 30, to reduce the number of revolutions of the engine to the number of revolutions for idling.

The automatic idling stop function is a function to stop the engine 11 if a predetermined condition is satisfied. In the embodiment, the engine controller D7 activates the automatic idling stop function in response to an automatic idling stop command from the controller 30, to stop the engine 11.

A main pump 14 and a pilot pump 15 as oil hydraulic pumps are connected to the engine 11. A control valve 17 is connected to the main pump 14 via a high-pressure oil pressure line 16.

The control valve 17 is an oil pressure control device that controls the oil pressure system of the shovel. Oil hydraulic actuators including an oil pressure motor 1A for right side traveling, an oil pressure motor 1B for left side traveling, the boom cylinder 7, the arm cylinder 8, the bucket cylinder 9, an oil pressure motor 21 for revolution, and the tilt bucket cylinder 64 are connected to the control valve 17 via the high-pressure oil pressure lines.

An operation unit 26 is connected to the pilot pump 15 via a pilot line 25 and a gate lock valve D6. Also, the control valve 17 is connected to the pilot pump 15 via a pilot line 25A and a switching valve D8. The operation unit 26 includes a lever 26A, a lever 26B, a pedal 26C, and an automatic tilt switch 26D. In the embodiment, the operation unit 26 is connected to the control valve 17 via an oil pressure line 27. A pressure-reducing valve V1 controlled by the controller 30 is provided on the oil pressure line 27. Also, the operation unit 26 is connected to a pressure sensor 29 via an oil pressure line 28.

The gate lock valve D6 switches communicating and cutoff states of the pilot line 25 that connects the pilot pump 15 and the operation unit 26 to each other. In the embodiment, the gate lock valve D6 is an electromagnetic valve that switches the communicating and cutoff states of the pilot line 25 in response to a command from the controller 30. The controller 30 determines the state of the gate lock lever D5 based on a state signal output by the gate lock lever D5. Then, if having determined that the gate lock lever D5 is in a state of being pulled up, the controller 30 outputs a communication command to the gate lock valve D6. In response to receiving the communication command, the gate lock valve D6 is opened to enable communication through the pilot line 25. As a result, an operation of the operator on the operation unit 26 becomes effective. On the other hand, if having determined that the gate lock lever D5 is in a state of being pressed down, the controller 30 outputs a cutoff command to the gate lock valve D6. In response to receiving the cutoff command, the gate lock valve D6 is closed to cut off the pilot line 25. As a result, an operation of the operator on the operation unit 26 becomes ineffective.

The switching valve D8 switches communicating and cutoff states of the pilot line 25A that connects the pilot pump 15 and the control valve 17 to each other. In the embodiment, the switching valve D8 is an electromagnetic proportional valve that switches the communicating and cutoff states of the pilot line 25A in response to a command from the controller 30. The controller 30 outputs a communication command to the switching valve D8 when starting automatic bucket tilt control, which will be described later. In response to receiving the communication command, the switching valve D8 is opened to enable communication through the pilot line 25A, to execute the automatic bucket tilt control.

The pressure sensor 29 detects pressure corresponding to an operation on the operation unit 26. The pressure sensor 29 outputs the detected value to the controller 30.

Figure 3:
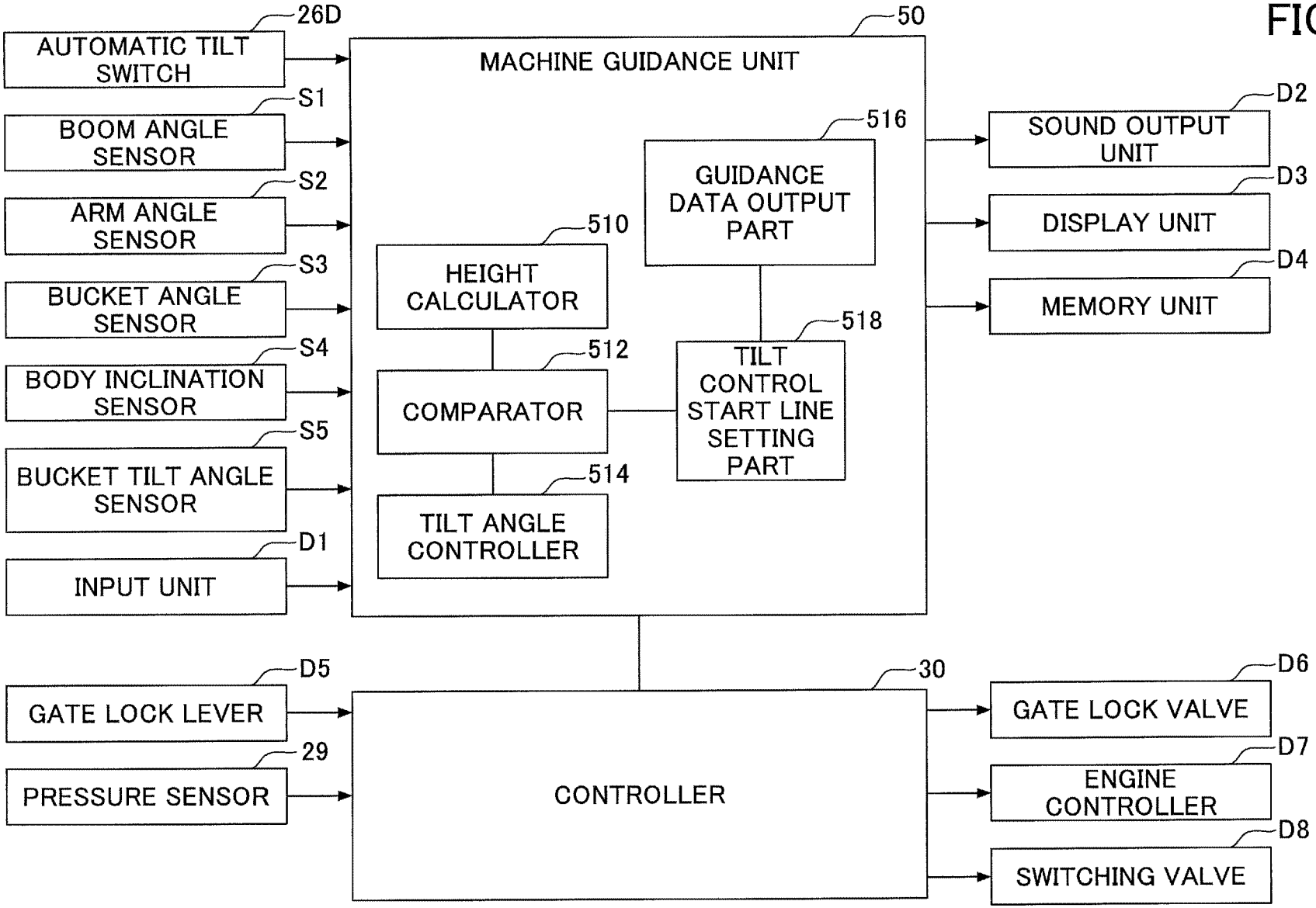
FIG. 3 is a block diagram illustrating a functional configuration of a controller and a machine guidance device.

Next, referring to FIG. 3, various functional elements provided in the controller 30 and the machine guidance device 50 will be described. FIG. 3 is a functional block diagram illustrating a configuration of the controller 30 and the machine guidance device 50.

In the embodiment, in addition to controlling operations of the entire shovel, the controller 30 controls whether to execute guidance by the machine guidance device 50. Specifically, the controller 30 determines whether the shovel is inactive based on the state of the gate lock lever D5, a detection signal from the pressure sensor 29, and the like. Then, if having determined that the shovel is inactive, the controller 30 sends a guidance stop command to the machine guidance device 50 so that guidance by the machine guidance device 50 is to be stopped.

Also, when outputting an automatic idling stop command to the engine controller D7, the controller 30 may output a guidance stop command to the machine guidance device 50. Alternatively, if having determined that the gate lock lever D5 is in a pressed-down state, the controller 30 may output a guidance stop command to the machine guidance device 50.

Next, the machine guidance device 50 will be described. In the embodiment, the machine guidance device 50 receives various signals and data output from the boom angle sensor S1, the arm angle sensor S2, the bucket angle sensor S3, the body inclination sensor S4, the bucket tilt angle sensor S5, the input unit D1, and the controller 30. The machine guidance device 50 calculates an actual working position of an attachment (for example, the bucket 6), based on a received signal and data. Then, if the actual working position of the attachment is different from a target working position, the machine guidance device 50 transmits an alarm command to the sound output unit D2 and the display unit D3, to issue an alarm. The machine guidance device 50 and the controller 30 are connected to a CAN (Controller Area Network) so as to be capable of communicating with each other.

The machine guidance device 50 includes functional units that execute various functions. In the embodiment, the machine guidance device 50 includes a height calculator 510, a comparator 512, a tilt angle controller 514, a guidance data output unit 516, and a tilt control start line setting part 518, as functional units for controlling operations of the attachment.

The height calculator 510 calculates a height at the tip (teeth end) of the bucket 6 from an inclination angle of the revolving upper body 3 calculated from angles of the boom 4, the arm 5, and the bucket 6 calculated from detection signals of the sensors S1-S3 and a detection signal of the sensor S4.

The guidance data output unit 516 reads guidance data including data related to a target excavation surface stored in advance in the memory unit of the machine guidance device 50 as described above, and outputs the data to the tilt control start line setting part 518. This configuration makes it possible for the operator to set a target excavation surface in advance by using the input unit D1.

The tilt control start line setting part 518 sets a tilt control start line at a position having a predetermined distance from the target excavation line in the guidance data, and outputs the guidance data to the comparator 512.

The comparator 512 compares the height at a tip (teeth end) of the bucket 6 calculated by the height calculator 510, with the tilt control start line represented in the guidance data output from the tilt control start line setting part 518.

Based on a comparison result obtained by the comparator 512, the tilt angle controller 514 determines whether a working part (for example, the teeth end) of the bucket 6 is at a position closer the target excavation line than the tilt control start line (is positioned between the tilt control start line and the target excavation line). If the working part of the bucket 6 is determined to be at a position closer the target excavation line than the tilt control start line, the tilt angle controller 514 controls the tilt angle of the bucket 6, to adjust the bucket line (for example, the teeth end line) of the bucket 6 to become parallel to the target excavation surface. Note that the bucket line is a line formed by the working part of the bucket 6, which includes, for example, the teeth end line connecting both ends of the cutting edge (an example of the working part), a back surface line along the edge of the back surface of the bucket (an example of the working part), and the like. In other words, the bucket line is defined as a line segment that connects at least two points of the working part contacting the target excavation surface. Specifically, the tilt angle controller 514 calculates a current angle deviation of the tilt angle of the bucket 6 with respect to the target excavation surface by using detection signals of the sensor S1-S4, and transmits a control signal to the controller 30 to reduce the calculated angle deviation. Based on this, the controller 30 executes automatic control so that the teeth end line of the bucket 6 is parallel to the target excavation surface. Also, for the calculation of the angle of the teeth end line of the bucket 6, a GNSS device or the like may be used in addition to the sensors S1-S4.

Here, the example has been described in which the working part of the attachment is the tip (teeth end) of the bucket 6; however, any position of the bucket 6 may be used as the working part. For example, in work done by using the back surface of the bucket 6, the back surface of the bucket 6 may be the working part.

Figure 4:
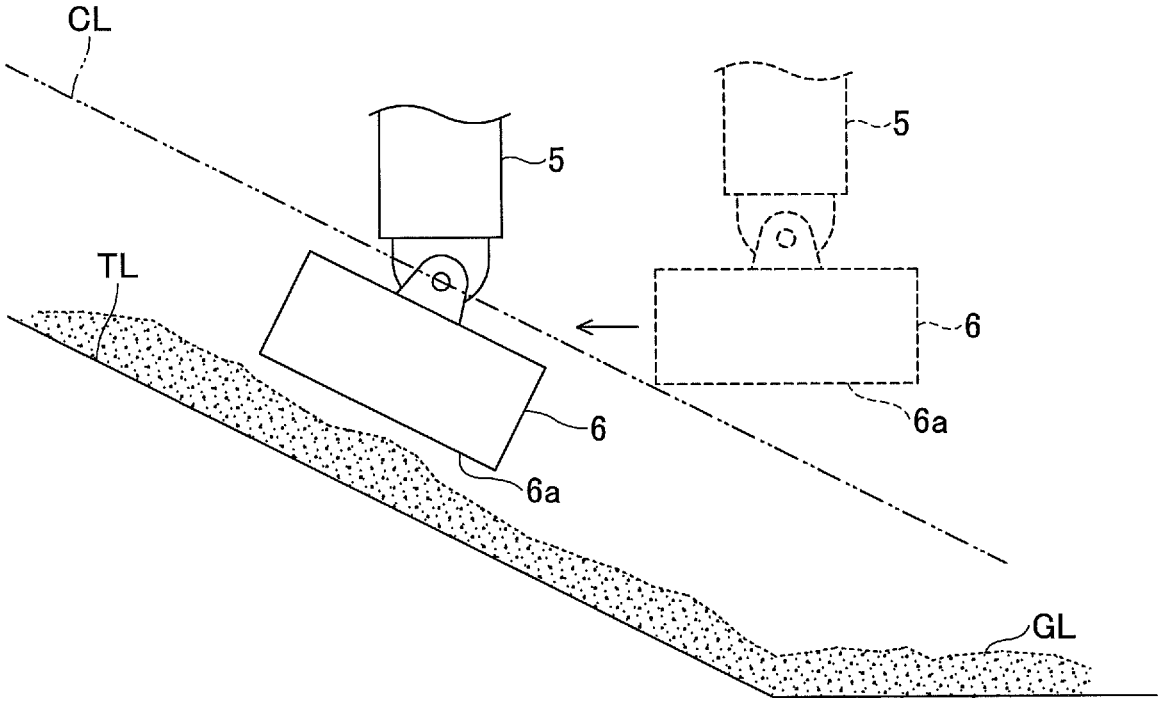
FIG. 4 is a diagram for describing automatic bucket tilt control.

Next, referring to FIG. 4, the automatic bucket tilt control by the machine guidance device 50 will be described. FIG. 4 is a diagram for describing an example of the automatic bucket tilt control according to the embodiment.

FIG. 4 illustrates control that makes the teeth end line of the bucket 6 parallel to the slope surface (slope). In FIG. 4, a tilt control start line CL that represents a tilt control start surface used as a reference to start the automatic bucket tilt control, is positioned to have a predetermined distance from a target line TL that represents a target excavation surface. Note that the target line TL is a line on the target excavation surface corresponding to the teeth end line of the bucket 6. The tilt control start line CL is set in the guidance data by the tilt control start line setting part 518 in FIG. 3 as described above.

In the automatic bucket tilt control according to the embodiment, when the bucket 6 is far from the target excavation surface (corresponding to the target line TL in FIG. 4), the automatic control of the tilt angle of the bucket 6 is not executed, but as designated by a dotted line in FIG. 4, the teeth end line 6*a* of the bucket 6 is maintained to be horizontal. If the bucket 6 approaches the target excavation surface, and the teeth end of the bucket 6 reaches the tilt control start surface (corresponding to the tilt control start line CL in FIG. 4), the automatic control of the tilt angle of the bucket 6 starts. Once the automatic control of the tilt angle has started, the tilt angle is adjusted so that the teeth end line 6*a* of the bucket 6 is maintained to be parallel to the target line TL. Determining whether the teeth end of the bucket 6 comes in contact with the tilt control start surface (corresponding to the tilt control start line CL in FIG. 4), is executed by the comparator 512 described above.

While the bucket 6 is positioned between the tilt control start surface (corresponding to the tilt control start line CL in FIG. 4) and the target excavation surface (corresponding to the target line TL in FIG. 4), the automatic bucket tilt control is continuously executed to make the teeth end line 6*a* of the bucket 6 parallel to the target excavation surface, by the signal from the controller 30. The automatic bucket tilt control is automatically executed by the machine guidance device 50, in which the operator of the shovel does not manually adjust the tilt angle of the bucket 6. Therefore, the operator of the shovel can precisely fit the teeth end line 6*a* of the bucket 6 with the target excavation surface even if the operator does not adjust the angle to the target surface of the teeth end line 6*a* of the bucket 6 during the excavation work.

However, if the work is done on the slope surface, and the operator operates the lever for revolution, the teeth end line 6*a* of the bucket 6 becomes not parallel to the target excavation surface. The same happens if the shovel faces a direction obliquely crossing the slope surface, and the boom or the like is operated. Therefore, if the position of the bucket 6 is lower than the tilt control start line CL, the operation of an oil hydraulic actuator under operation is limited even if the operator performs a revolution operation or operates on the boom, the arm, the bucket, or the like, so that the angle between the teeth end line 6*a* of the bucket 6 and the target excavation surface is maintained to be less than or equal to a predetermined angle. Specifically, if the angle between the teeth end line 6*a* of the bucket 6 and the target excavation surface exceeds the predetermined angle, the pilot pressure is reduced by the pressure-reducing valve V1. Accordingly, it is possible to limit the operational speed of a revolution operation and an operation on the boom, the arm, the bucket, or the like.

After the excavation operation completed, and the teeth end of the bucket 6 has moved outside (upward in FIG. 4) of the tilt control start surface (the tilt control start line CL), the automatic bucket tilt control is released (disabled), and as designated by the dotted line in FIG. 4, the teeth end line 6*a* of the bucket 6 is leveled. This makes it possible, for example, if earth and sand are scooped up by the bucket 6, to prevent the earth and sand from falling out of the bucket 6. The tilt angle of the bucket 6 after the release is determined in advance depending on contents of work and the like. Also, to realize this control, the load imposed on the bucket 6, the arm 5, or the boom 4 may be monitored, for example, when the bucket 6 is stuck in the earth surface or the bucket 6 scoops up earth and sand, and when this load becomes lower than a predetermined value, the teeth end line 6*a* of the bucket 6 may be leveled. In this way, the automatic bucket tilt control may be released (disabled), depending on the detected load so as to make the teeth end line 6*a* of the bucket 6 leveled as designated by the dotted line in FIG. 4.

If an acceleration sensor is used as the bucket tilt angle sensor S5, it is possible to determine whether the teeth end line 6*a* of the bucket 6 is level only based on the detection signal of the bucket tilt angle sensor S5. If another angle sensor such as a rotary encoder is used as the bucket tilt angle sensor S5, it is possible to determine whether the teeth end line 6*a* is level, by obtaining the angle of the teeth end line 6*a* of the bucket 6, based on the output signals from the sensors S1-S4 described above.

Note that the automatic bucket tilt control according to the embodiment may be activated when the operator of the shovel wants to adjust the bucket tilt angle automatically. Therefore, as illustrated in FIG. 2, the automatic tilt switch 26D, which is used for turning on and off the automatic bucket tilt control, may be attached at the tips of the levers 26A-26B and the like, and the automatic tilt switch 26D may be turned on only when the operator of the shovel wants to execute the automatic bucket tilt control. In other words, only when there is a command from the operator, a communication command is output to the switching valve D8, to enable the automatic bucket tilt control. Note that the automatic tilt switch 26D may be attached to the pedal 26C.

Also, although the tilt control start line CL is set as the reference to start the automatic bucket tilt control to make the teeth end line 6*a* of the bucket 6 parallel to the target line TL, the control is not limited as such. For example, when the bucket 6 touches the earth surface (a ground line GL in FIG. 4), the teeth end line 6*a* of the bucket 6 may be made parallel to the target line TL.

Although the automatic bucket tilt control according to the embodiment has been described assuming that the machine guidance device 50 executes the control, the control is not necessarily executed by the machine guidance device 50. For example, if guidance data including a target line TL is available, the controller 30 or another control device may execute the control.

Figure 5A:
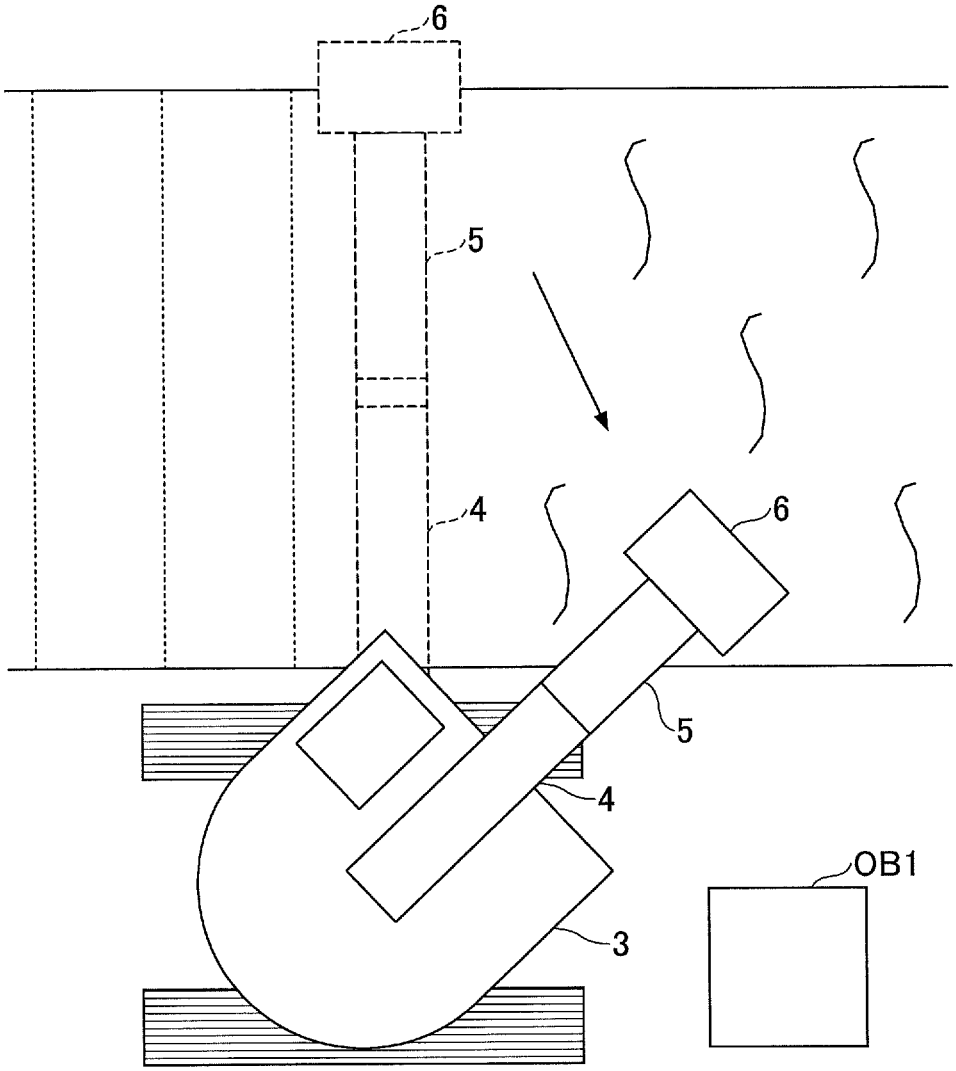
FIG. 5A is a diagram illustrating an example of excavation work by a bucket.
Figure 5B:
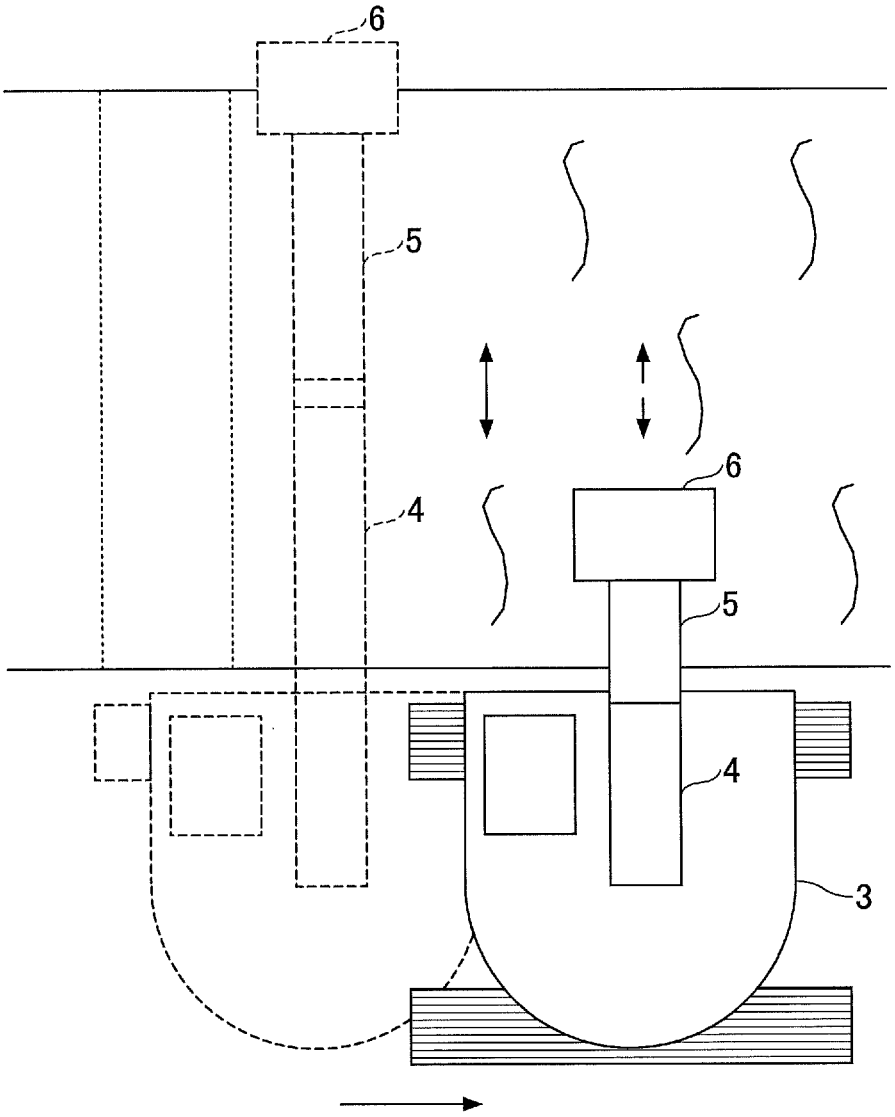
FIG. 5B is a diagram illustrating another example of excavation work by a bucket.

FIG. 5A and FIG. 5B are diagrams illustrating examples of excavation work by a bucket. FIG. 5A illustrates an example of excavation work in which it is preferable to enable the automatic bucket tilt control according to the above embodiment. FIG. 5B illustrates an example of excavation work in which the automatic bucket tilt control according to the above embodiment is disabled.

In FIG. 5A, a surface excavated by the bucket 6 is a slope surface. The slope surface is excavated by moving the bucket 6. Specifically, the bucket 6 is not moved just linearly along the slope surface, but is moved also in the lateral direction of the slope surface by revolving the revolving upper body 3. In such excavation work, the teeth end line 6*a* of the bucket 6 is parallel to the slope surface when the bucket 6 is at a position designated by the dotted lines. However, if the shovel is revolved, the teeth end line 6*a* of the bucket 6 becomes inclined to the slope surface (this inclination is inclination in a direction perpendicular to the page surface, and hence, not illustrated in FIG. 5A). Therefore, the angle deviation of the tilt angle of the bucket 6 to the target surface becomes large.

Thereupon, if the automatic bucket tilt control according to the embodiment is enabled, it is possible for the operator to make the teeth end line 6*a* of the bucket 6 adjusted to be parallel to the slope surface automatically, by simply operating the boom 4 and the arm 5 to move the bucket 6. Therefore, excavation is performed while having the teeth end line 6*a* of the bucket always parallel to the slope surface, which makes the entire excavation surface parallel to the slope surface.

On the other hand, to perform the same excavation work with the disabled automatic bucket tilt control according to the embodiment, the operator has to operate the boom 4 and the arm 5 to move the bucket 6 while adjusting the tilt angle of the bucket 6. However, it is difficult to determine and adjust the tilt (inclination) of the bucket 6 to the slope surface. Therefore, for example, as illustrated in FIG. 5B, the operator may execute an excavation operation by operating only the arm 5 and the boom 4, and then, without revolving the revolving upper body 3, moves the entire shovel a bit horizontally to perform a next excavation operation. Although it is possible for the operator to perform excavation without adjusting the tilt angle in this way, it is troublesome to perform the excavation work by moving the entire shovel. On the other hand, if the automatic bucket tilt control according to the embodiment is enabled, it is possible to precisely perform the excavation work of the slope surface without moving the entire shovel. Also, even if the entire shovel cannot be moved to an appropriate workplace due to an obstacle OB1 or the like (see FIG. 5A), if the automatic bucket tilt control according to the embodiment is enabled, it is possible to adjust the tilt angle of the bucket 6 automatically while revolving the revolving upper body 3, and to make the teeth end line 6*a* of the bucket 6 parallel to the target line.

As described above, by enabling the automatic bucket tilt control according to the embodiment when performing excavation work, it is always possible to make the teeth end line 6*a* of the bucket 6 parallel to a target excavation surface, and to perform the excavation work of the slope surface easily and precisely.

It should be understood that the invention is not limited to the above-described embodiment, but may be modified into various forms on the basis of the spirit of the invention. Additionally, the modifications are included in the scope of the invention.

What is claimed is:

1. A vehicle shovel, comprising:

an arm rotatably attached to a boom rotatably attached to a revolving body;

a bucket rotatably attached to the arm;

a tilt mechanism configured to rotate the bucket so as to rotate a bucket line relative to the arm, said bucket line being defined by a line connecting between at least two points in the bucket and extending in a left-right direction of the bucket;

a bucket tilt angle sensor configured to detect a tilt angle indicating a rotation angle of the bucket line; and a tilt angle controller configured to control adjusting the tilt angle, wherein the tilt angle controller calculates a current angle deviation of the tilt angle based on a comparison of the bucket line calculated based on a tilt angle value detected by the bucket tilt angle sensor and a predetermined target excavation surface, generate a control signal to reduce the calculated current angle deviation of the tilt angle and control the tilt mechanism by the control signal.

2. The vehicle shovel as claimed in claim 1, wherein the target excavation surface can be set by a worker in advance.

3. The vehicle shovel as claimed in claim 1, wherein the left-right direction includes a direction parallel to a cutting edge of the bucket.

4. The vehicle shovel as claimed in claim 1, wherein the automatic control of the tilt angle is enabled only in a case where a command is issued by an operator.

5. The vehicle shovel as claimed in claim 4, wherein the command is triggered by a switch attached to an operation unit.

6. The vehicle shovel as claimed in claim 1, wherein the tilt angle controller is configured to automatically start controlling the tilt mechanism by the control signal when the working part of the bucket comes within a predetermined distance from the target excavation surface.

7. The vehicle shovel as claimed in claim 1, wherein in a case where a position of a working part of the bucket is within a predetermined distance from the target excavation surface, in response to receiving an operation on one of oil hydraulic actuators corresponding to the revolving body, the boom, the arm, and the bucket, respectively, an operation of the oil hydraulic actuator being operated is limited so that an angle between the bucket line and the target excavation surface is less than or equal to a predetermined angle.

8. The vehicle shovel as claimed in claim 1, wherein the shovel detects a load imposed on the bucket, and if a value representing the detected load is less than a predetermined value, disables the automatic control of the tilt angle.

9. The vehicle shovel as claimed in claim 6, wherein when the tilt angle controller configured to control is configured to control the bucket line to be parallel to a horizontal line upon disabling automatic control of the tilt angle is disabled.

10. The vehicle shovel as claimed in claim 1, wherein the vehicle shovel further comprises an input apparatus configured to input the target excavation surface that includes a surface that inclines relative to a horizontal plane.

11. The vehicle shovel as claimed in claim 1, wherein a boom angle sensor to detect a rotational speed of the boom with respect to the revolving body is attached to the boom, wherein an arm angle sensor to detect a rotational speed of the arm with respect to the boom is attached to the arm, wherein a bucket angle sensor to detect a rotational speed of the bucket with respect to the arm is attached to the bucket, and wherein the bucket tilt angle sensor detects the tilt angle of the bucket with respect to the target excavation surface, based on detection signals output from the boom angle sensor, the arm angle sensor, and the bucket angle sensor.

12. The vehicle shovel as claimed in claim 11, wherein the tilt angle of the bucket with respect to the target excavation surface is detected further based on a detection signal output from a body inclination sensor that is attached to the revolving body, and detects inclination angles in a back-and-forth direction and a right-and-left direction of the revolving body.

* * * * *